United States Patent [19]

Yasuda et al.

[11] Patent Number: 4,485,322

[45] Date of Patent: Nov. 27, 1984

[54] ULTRASONIC TRANSDUCER

[75] Inventors: Eturo Yasuda; Shigeyuki Akita; Masao Kodera, all of Okazaki, Japan

[73] Assignee: Nippon Soken, Inc., Nishio, Japan

[21] Appl. No.: 360,767

[22] Filed: Mar. 22, 1982

[30] Foreign Application Priority Data

Apr. 7, 1981 [JP] Japan ..... 56-52131

[51] Int. Cl.[3] ..... H04R 17/00; H04R 1/00

[52] U.S. Cl. ..... 310/332; 179/110 A; 310/322; 367/140

[58] Field of Search ..... 179/110 A; 310/322, 310/332; 367/140

[56] References Cited

FOREIGN PATENT DOCUMENTS 2547606 5/1976 Fed. Rep. of Germany ... 179/110 A

*Primary Examiner*—Richard A. Farley

*Attorney, Agent, or Firm*—Cushman, Darby & Cushman

[57] ABSTRACT

Provided is an ultrasonic transducer having a resonator which defines a space together with a bimorph cell disposed in the ultrasonic transducer. The space is fluid-tightly closed by the top portion of the resonator, thereby to keep water, such as for example, rainwater or cleaning water from entering into the space.

7 Claims, 10 Drawing Figures

ULTRASONIC TRANSDUCER

BACKGROUND OF THE INVENTION

The present invention relates to an ultrasonic transducer and, more particularly, to an ultrasonic transducer suitable for use in an obstacle detection device for automobiles capable of detecting any obstacle which may lie ahead or behind the running automobile.

Aerial ultrasonic transducer incorporating a bimorph cell have been put into practical use. One of these known transducer has two keep plates between which the bimorph cell is clamped. In this type of transducers, there is a fear that the bimorph cell may come off from the keep plates due to an externally applied impact. In addition, audible noises are generated from the points on the keep plates in a position where the bimorph cell is supported, when the transducer is used for the transmission of wave. It is also to be pointed out that this type of transducer has a rather inferior sensitivity.

In order to obviate these drawbacks, there has been proposed a horn type ultrasonic transducer in which a disc-shaped bimorph cell is supported along the nodal circle thereof and a coupling cone is inserted into a central hole of the disc-shaped bimorph cell. Also, a metallic horn type resonator is bonded to the bimorph cell. Due to the attaching of the metallic resonator, the bimorph cell makes a vibration at its central portion at a large amplitude when an ultrasonic wave is applied at the neutral frequency thereof, so that a comparatively high output voltage is derived from the peripheral part of the bimorph cell.

This horn type ultrasonic transducer, however, has the following problem when it is mounted on an automobile as an obstacle detecting measure. Namely, rainwater, as well as water for washing the automobile, tends to come into the horn type resonator so that many water droplets attach to the bimorph cell and the horn type resonator due to the surface tension to seriously deteriorate the wave transmitting and receiving sensitivities. The attaching of the water droplets cannot be avoided even when the transducer is directed horizontally or downwardly.

SUMMARY OF THE INVENTION

Accordingly, an object of the invention is to provide an ultrasonic transducer improved to avoid the undesirable attaching of water droplets, thereby to overcome the above-described problem of the prior art.

To this end, according to the invention, there is provided an ultrasonic transducer comprising: a terminal board carrying terminals and provided with a projecting portion having a free end; a bimorph cell having an upper surface and a lower surface attached, at the center thereof, to the free end of the projecting portion of the terminal board through an elastic binding agent; a resonator connected to the upper surface of the bimorph cell and defining a fluid-tight space together with the upper surface; and lead wires electrically connecting the upper and lower surfaces of the bimorph cell to the terminals.

According to this arrangement, the bimorph cell can make a deflection at a sufficiently large amplitude in response to the sound pressure applied to the peripheral portion thereof, because the bimorph cell is supported resiliently at its central portion. In addition, since the space defined between the resonator and the bimorph cell is sealed in fluid-tight manner, the water is prevented from coming into this space. Furthermore, since the resonator is so shaped as to provide a good matching of impedance between the air and the bimorph cell, it is possible to obtain a high sensitivity of the waterproof ultrasonic transducer.

The above and other objects, features and advantages of the invention will become clear from the following description of the preferred embodiments taken in conjunction with the accompanying drawings.

DESCRIPTION OF THE PREFERRED EMBODIMENTS

Before turning to the description of the preferred embodiments, a description will be made hereinunder with specific reference to FIGS. 1 and 2 as to the conventionally used ultrasonic transducer, in order to facilitate the understanding to the features and advantages of the present invention.

There are two types of aerial ultrasonic transducer making use of piezoelectric ceramics.

Figure 1:
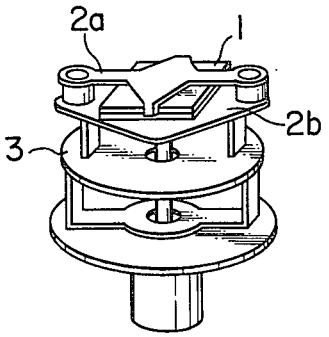
FIGS. 1 and 2 are perspective views of the internal structure of conventionally used ultrasonic transducers which are the prior arts.

Referring first to FIG. 1 showing a first type of these known transducer in perspective view, the transducer has a square bimorph cell 1 having nodes on nodal lines interconnecting mid points of opposing sides of the square bimorph cell 1. Therefore, the upper one 2*a* of two keep plates 2*a*, 2*b* clamping the bimorph cell 1 therebetween serves to press the bimorph cell 1 onto the lower one 2*b* along the nodal lines of the bimorph cell 1. The central portion of the upper keep plate 2*a* has a shape like a diamond, so that the deflection of the bimorph cell 1 is emphasized when it is deflected in response to the ultrasonic wave applied thereto. The lower keep plate 2*b* is provided at its central part with a hole (not shown), in order to enhance the vibration effect caused by the wave reflected by a reflecting plate 3. This ultrasonic transducer, however, has the following disadvantage. Namely, the bimorph cell 1 tends to come off from the keep plates 2*a*, 2*b* when the transducer is impacted by an externally applied shock. In addition, audible noises are generated undesirably at the points at which the bimorph cell is supported. Furthermore, it is to be pointed out that this transducer has a rather low sensitivity.

Figure 2:
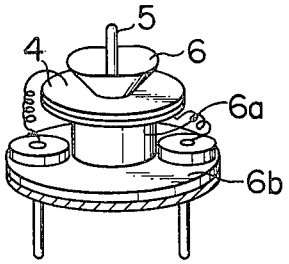

FIG. 2 shows another type of known ultrasonic transducer in which a disc-shaped bimorph cell 4 is fixed along its nodal circle to a cylinder 6*a* which in turn is supported by a terminal board 6*b*. A coupling core 5 is inserted into a central hole (not shown) of the disc-shaped bimorph cell 4. Also, a metallic horn type resonator 6 is coupled to the disc-shaped bimorph cell 4. According to this arrangement, the bimorph cell 4 makes a vibration at its central portion with a large amplitude when an ultrasonic wave signal is applied thereto at the natural frequency, due to the presence of the metallic resonator 6, so that a signal voltage is generated across the bimorph cell 4. This ultrasonic transducer, therefore, exhibits a high sensitivity and high resistance to impact as compared with the ultrasonic transducer shown in FIG. 1. The ultrasonic transducer shown in FIG. 2, however, suffers the following disadvantage. Namely, when the ultrasonic transducer as shown in FIG. 2 is mounted on the exterior of the rear part of an automobile body as a rear obstacle detection device, rain water or a rinsing water inconveniently comes into the ultrasonic transducer through the horn type resonator 6. The water thus coming into the transducer forms waterdrops due to its surface tension, and the waterdrops inconveniently attach to the surface of the bimorph cell 4 and the metallic resonator 6 so as to seriously lower the sensitivity of the transducer. The attaching of the waterdrops cannot be avoided even if the ultrasonic transducer is oriented horizontally or downwardly.

These problems of the prior art, however, can be overcome by the present invention as will be understood from the following description of the preferred embodiments.

Figure 3A:
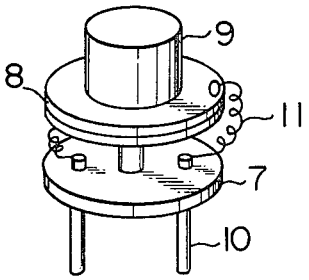
FIG. 3*a* is a perspective view of the internal structure of an ultrasonic transducer constructed in accordance with a first embodiment of the invention.
Figure 3B:
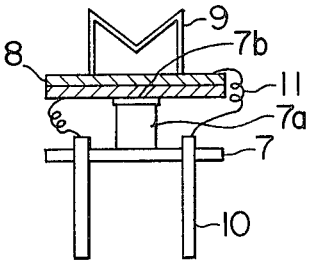
FIG. 3*b* is a sectional veiw of the ultrasonic transducer as shown in FIG. 3*a;*

Referring first to FIGS. 3*a* and 3*b* showing a first embodiment of the invention, a terminal board 7 carrying terminals 10 is provided at its center with an upward projecting portion 7*a*. A bimorph cell, i.e. a disc-shaped piezoelectric cell 8, is attached to the upper end surface of the projecting portion 7*a* by means of an elastic binding agent 7*b*. A metallic resonator 9 is connected to the surface of the piezoelectric element 8 opposite to the projecting portion 7*a*. The metallic resonator 9 is a cylindrical member provided with a conically recessed top wall, and is provided to obtain an impedance matching between the piezoelectric element 8 and the air. To this end, a metallic material having a high Q value such as aluminum is used as the material of the metallic resonator 9. A reference numeral 11 designates a lead for electrically connecting the terminals 10 on the terminal board 10 to the piezoelectric element 8. The bimorph cell, i.e. the piezoelectric element 8, is constituted by two sheets of ceramic vibrators adhered to each other by a conductive binding agent in such a manner as to provide opposite directions of polarization. The oscillation mode is deflecting oscillation.

The ultrasonic transducer of the first embodiment heretofore described operates in a manner explained hereinunder. As an ultrasonic wave signal is applied to the transducer, the piezoelectric element 8 makes the deflecting oscillation by the sound pressure of the signal. The amplitude of the deflecting oscillation is enhanced by the presence of the metallic resonator 9 which is provided to obtain the matching of impedance between the piezoelectric element 8 and the air.

As will be clearly understood from FIG. 3*b*, the space between the metallic resonator 9 and the piezoelectric element 8 is sealed from the ambient air by the top wall. Therefore, the sound pressure applies a stress to the peripheral portion of the piezoelectric element 8 through the metallic resonator 9. Since the piezoelectric element 8 is connected to the projecting portion 7*a* of the terminal board 7 through an elastic binding agent 7*b*, the stress causes a vertically deflecting vibration around the fulcrum constituted by the piezoelectric element 8 which in turn makes the piezoelectric element 8 expand and shrink in the radial direction. A voltage produced as a result of the radial expansion and shrinkage of the piezoelectric element 8 is picked up as the output.

In this ultrasonic transducer, rain water and rinsing water are prevented from coming into the space defined by the piezoelectric element 8 and the metallic resonator 9, because this space is completely closed and sealed from the ambient air. In addition, this transducer exhibits a high sensitivity because the piezoelectric element 8 is supported at its center.

Figure 4:
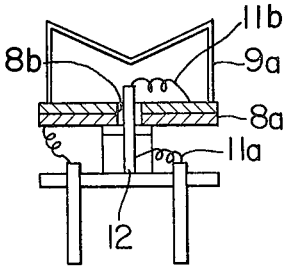
FIG. 4 shows in section a modification of the ultrasonic transducer as shown in FIG. 3*a;*

FIG. 4 shows a modification of the first embodiment, in which the outside diameter of the cylindrical portion of the metallic resonator 9*a* is increased so that the latter is connected to the portion near the outer periphery of the piezoelectric element 8*a*. Therefore, the metallic resonator 9*a* imparts the stress to the piezoelectric element 8*a* at a portion of the latter remote from the central support thereof, thereby to increase the moment of force. This in turn increases the amplitude of deflecting oscillation of the piezoelectric element 8*a* and, hence, a higher level of the output voltage. This arrangement, however, makes it difficult to connect the lead to the upper surface of the piezoelectric element 8*a*. Therefore, in this modification, a metal rod 12 is inserted into the sealed space through a hole 8*b* formed in the center of the piezoelectric element 8*a*, and the lead is connected between the upper end of the rod 12 and the upper surface of the piezoelectric element 8*a*. Namely, a lead 11*a* is electrically connected to the upper surface of the piezoelectric element 8*a* through the metallic rod 12 and a lead 11*b*.

Figure 5:
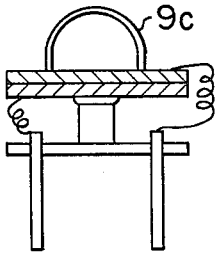
FIG. 5 is a sectional view of an ultrasonic transducer constructed in accordance with a second embodiment of the invention.

FIG. 5 shows an ultrasonic transducer in accordance with a second embodiment of the invention in which the metallic resonator 9*c* has a cylindrical form with a dome-shaped top. Other portions are materially identical to the first embodiment explained in connection with FIGS. 3 and 4.

Figure 6:
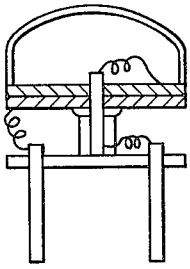
FIG. 6 shows in section a modification of the ultrasonic transducer as shown in FIG. 5.

FIG. 6 shows a modification of the ultrasonic transducer of the second embodiment. The point of modification is materially identical to the modification of the first embodiment shown in FIG. 4.

Figure 7:
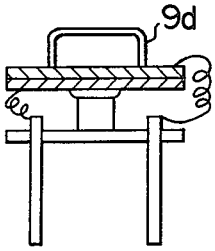
FIG. 7 is a sectional veiw of an ultrasonic transducer constructed in accordance with a third embodiment of the invention.
Figure 8:
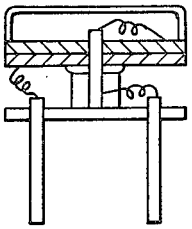
FIG. 8 shows in section a modification of the ultrasonic transducer as shown in FIG. 7.

FIG. 7 shows an ultrasonic transducer in accordance with a third embodiment of the invention in which the metallic resonator 9*d* has a flat top, while FIG. 8 shows a modification of the third embodiment, with a point of modification substantially same as that shown in FIG. 4.

Figure 9:
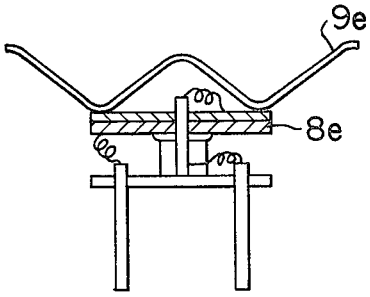
FIG. 9 is a sectional view of an ultrasonic transducer constructed in accordance with a fourth embodiment of the invention.

FIG. 9 shows an ultrasonic transducer constructed in accordance with a fourth embodiment of the invention in which the metallic resonator 9*e* is constituted by an annular corrugated plate. In this case, the electric connection of the lead to the upper surface of the piezoelectric element 8*e* is achieved through a metallic rod as in the case of the modification shown in FIG. 4.

Although the invention has been described through specific terms, the described embodiments are not exclusive and various changes and modifications may be imparted thereto without departing from the spirit and scope of the invention which is limited solely by the appended claims.

What is claimed is:

1. An ultrasonic transducer comprising:

i. a terminal board carrying terminals and provided with a projecting portion having a free end;

ii. a bimorph cell having an upper surface and a lower surface attached, at the center thereof, to the free end of said projecting portion through an elastic binding agent;

iii. a cylindrical resonator connected to said upper surface of said bimorph cell, having a recessed top wall and defining a fluid-tight space therein together with said upper surface of said bimorph cell; and iv. lead wire electrically connecting said upper and lower surfaces of said bimorph cell to said terminals.

2. An ultrasonic transducer as set forth in claim 1, wherein said cylindrical resonator has a diameter substantially equal to the diameter of said bimorph cell.

3. An ultrasonic transducer as set forth in claim 2, wherein said transducer further comprises a metal rod piercing through said bimorph cell and entering into said space, through which said upper surface of said bimorph cell is electrically connected to the associated one of said terminals.

4. An ultrasonic transducer comprising:

i. a terminal board carrying terminals and provided with a projecting portion having a free end;

ii. a bimorph cell having an upper surface and a lower surface attached, at the center thereof, to the free end of said projecting portion through an elastic binding agent;

iii. a cylindrical resonator connected to said upper surface of said bimorph cell, having a dome-shaped top wall, and defining a fluid-tight space therein together with said upper surface of said bimorph cell; and iv. lead wires electrically connecting said upper and lower surfaces of said bimorph cell to said terminals.

5. An ultrasonic transducer as set forth in claim 4, wherein said cylindrical resonator has a diameter substantially equal to the diameter of said bimorph cell.

6. An ultrasonic transducer as set forth in claim 5, wherein said transducer further comprises a metal rod piercing through said bimorph cell and entering into said space, through which said upper surface of said bimorph cell is electrically connected to the associated one of said terminals.

7. An ultrasonic transducer comprising:

i. a terminal board carrying terminals and provided with a projecting portion having a free end;

ii. a bimorph cell having an upper surface and a lower surface attached at the center thereof, to the free end of said projecting portion through an elastic binding agent;

iii. a resonator made of annular corrugated plate having a conical wall attached to said upper surface of said bimorph cell so as to define a fluid-tight space;

iv. a metal rod piercing through said bimorph cell and entering into said space so as to be electrically connected to the upper surface of said bimorph cell;

v. lead wires electrically connecting said metal piece rod and said lower surface of said bimorph cell to said associated terminals.

* * * * *